US009403075B1

(12) United States Patent
Morgan

(10) Patent No.: US 9,403,075 B1
(45) Date of Patent: Aug. 2, 2016

(54) METHODS AND APPARATUS FOR TRAINING SYSTEM FOR BALL STRIKING

(71) Applicant: Brent Morgan, Glendale, AZ (US)

(72) Inventor: Brent Morgan, Glendale, AZ (US)

( * ) Notice: Subject to any disclaimer, the term of this patent is extended or adjusted under 35 U.S.C. 154(b) by 0 days.

(21) Appl. No.: 15/016,477

(22) Filed: Feb. 5, 2016

(51) Int. Cl.
*A63B 69/00* (2006.01)

(52) U.S. Cl.
CPC ..... *A63B 69/002* (2013.01); *A63B 2208/0204* (2013.01)

(58) Field of Classification Search
CPC ..... A63B 69/002; A63B 2208/0204
USPC ..... 473/419, 422–429, 446, 575
See application file for complete search history.

(56) References Cited

U.S. PATENT DOCUMENTS 1,862,044 A 6/1932 White
4,576,379 A 3/1986 Juhasz
4,706,964 A 11/1987 Genovese
5,792,014 A * 8/1998 Brown ..... A63B 69/0079 473/430
5,957,789 A * 9/1999 Ainscough ..... A63B 69/0079 473/423
6,099,419 A 8/2000 Incaudo et al.
6,168,539 B1 * 1/2001 Maina ..... A63B 43/007 473/424
7,364,517 B1 4/2008 Johnsen
7,850,535 B2 12/2010 Noble et al.
8,083,618 B2 12/2011 Coscarelli et al.
8,932,155 B2 * 1/2015 Moore ..... A63B 63/083 473/422
9,011,277 B2 4/2015 Schell

* cited by examiner

*Primary Examiner* — Nini Legesse
(74) *Attorney, Agent, or Firm* — The Noblitt Group, PLLC

(57) ABSTRACT

A training system according to various aspects of the present technology may comprise a ball retention device coupled to a base and a dampening system coupled to the ball retention device and configured to return a kicked ball to its original resting location with minimal oscillation. The base may be configured to comprise a portable unit that may be selectively weighted to increase stability during use. A force measurement system may be coupled to the dampening system and be configured to measure the kicking force applied to the ball to calculate a speed value for the kicked ball and display the speed value to the user.

28 Claims, 4 Drawing Sheets

METHODS AND APPARATUS FOR TRAINING SYSTEM FOR BALL STRIKING

BACKGROUND OF THE TECHNOLOGY

Athletic training often requires an athlete to perform repetitive tasks directed towards mastering a movement, increasing skill, and improving performance. In sports that use a ball at least some of the repetitive tasks include striking the ball with a part of the body such as a foot or a piece of equipment such as a bat or a hockey stick. Traditionally this type of practice requires the use of multiple balls in succession otherwise the training becomes inefficient as each time a ball is struck it must be recovered before it can be struck again.

To solve this problem many different solutions have been utilized such as nets to capture balls that have been kicked, hit, or otherwise struck to prevent them from traveling too far from the user. Though an improvement it is still necessary for the user to collect and reset the ball in place before the ball can be struck again. Another solution has been the use of practice balls that are designed to limit their flight through the air after being struck. A drawback of these types of practice balls is that they commonly do not completely simulate the effects of striking a normal ball and as a result provide limited feedback. Yet another solution has been to attach a tether to a normal ball so that ball flight can be limited to the distance of the tether. Although more effective than using a practice ball, a drawback of using a tether with a ball such as a soccer ball is that the ball must still be recovered and placed back into a position so that it may be kicked again. This increases the time between each kick, which decreases the efficiency of the device. Other systems utilize a tether and attempt to automatically reset the ball back into its original position before being kicked or struck. These systems provide somewhat more efficiency but still suffer from drawbacks. For example, in this type of system the ball is returned to its originating location as a result of gravity. The user may still have to wait before striking the ball again due to excessive oscillation of the ball.

SUMMARY OF THE TECHNOLOGY

A training system according to various aspects of the present technology may comprise a ball retention device coupled to a base and a dampening system coupled to the ball retention device and configured to return a kicked ball to its original resting location with minimal oscillation. The base may be configured to comprise a portable unit that may be selectively weighted to increase stability during use. A force measurement system may be coupled to the dampening system and be configured to measure the kicking force applied to the ball to calculate a speed value for the kicked ball and display the speed value to the user.

BRIEF DESCRIPTION OF THE DRAWINGS

A more complete understanding of the present technology may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in a different order are illustrated in the figures to help to improve understanding of embodiments of the present technology.

DETAILED DESCRIPTION OF EXEMPLARY EMBODIMENTS

The present technology may be described in terms of functional block components and various processing steps. Such functional blocks may be realized by any number of hardware or software components configured to perform the specified functions and achieve the various results. For example, the present technology may employ various sensors, detectors, materials, connectors, and the like, which may carry out a variety of functions. In addition, the present technology may be practiced in conjunction with any number of ball types, and the system described is merely one exemplary application for the technology. Further, the present technology may employ any number of conventional techniques for dissipating energy, sensing movement, collecting data, processing data, and the like.

Methods and apparatus for a training system for ball striking according to various aspects of the present technology may operate in conjunction with any suitable mobile and/or stationary device for positioning a ball in a desired location. Various representative implementations of the present technology may be applied to any system for athletic training or positioning and repositioning a ball such that it can be repetitively struck. Certain representative implementations may include, for example, portable and/or non-portable bases, hands free operation, adjustability, interoperability with multiple types of balls or like sporting devices, and visual feedback of performance.

Figure 1:
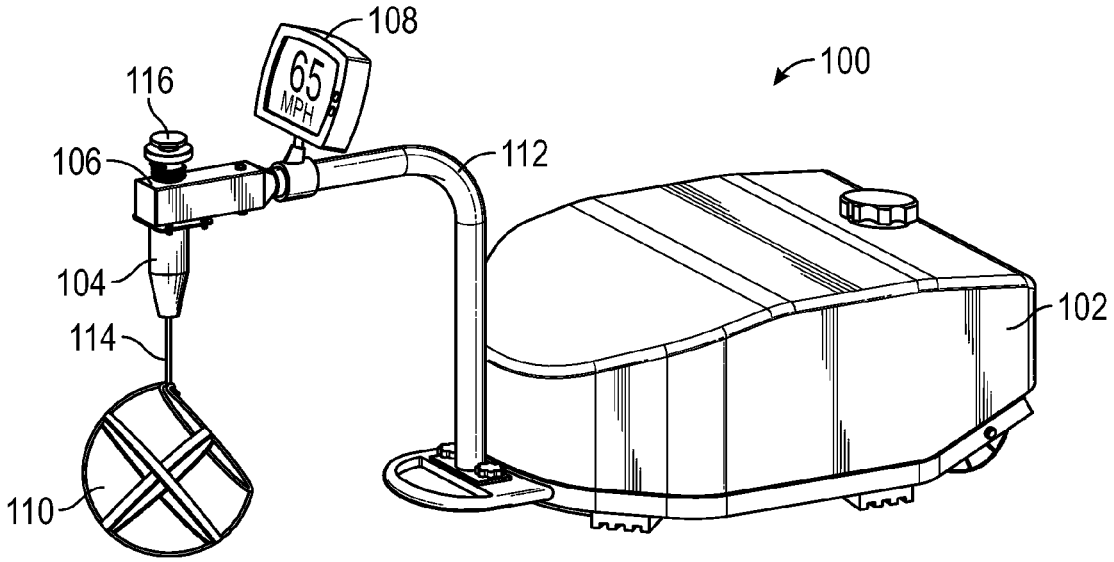
FIG. 1 representatively illustrates a perspective view of a training device in accordance with an exemplary embodiment of the present technology.
Figure 2:
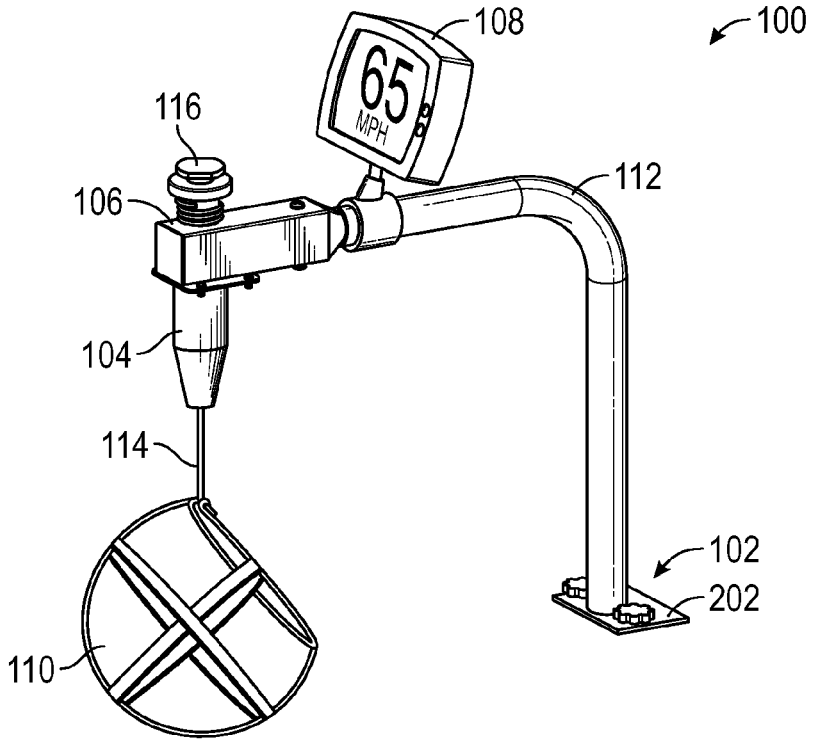
FIG. 2 representatively illustrates a perspective view of an alternative embodiment of the training device in accordance with the present technology.
Figure 3:
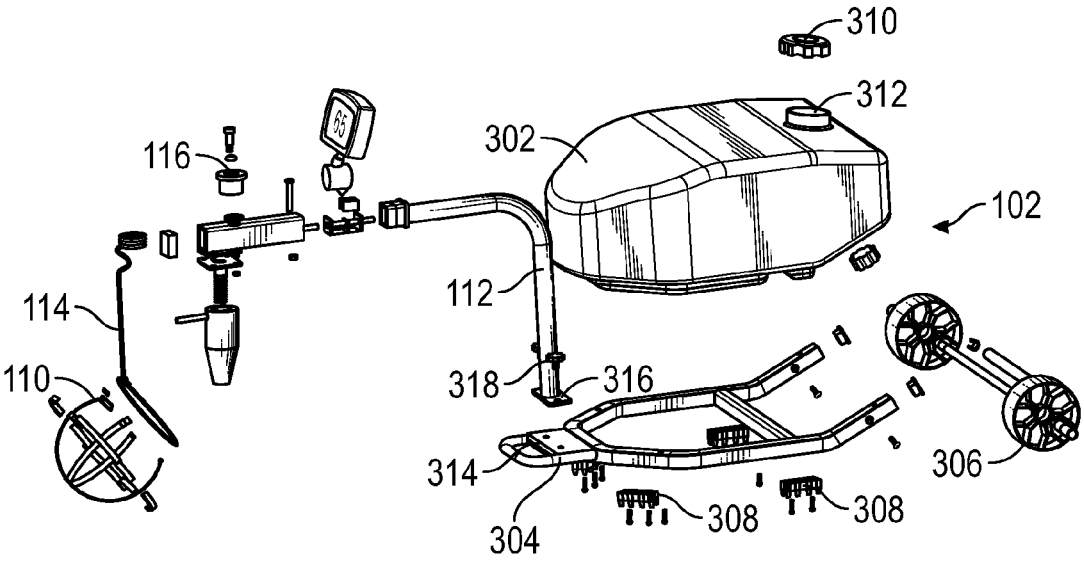
FIG. 3 representatively illustrates an exploded view of the training device in accordance with an exemplary embodiment of the present technology.
Figure 4:
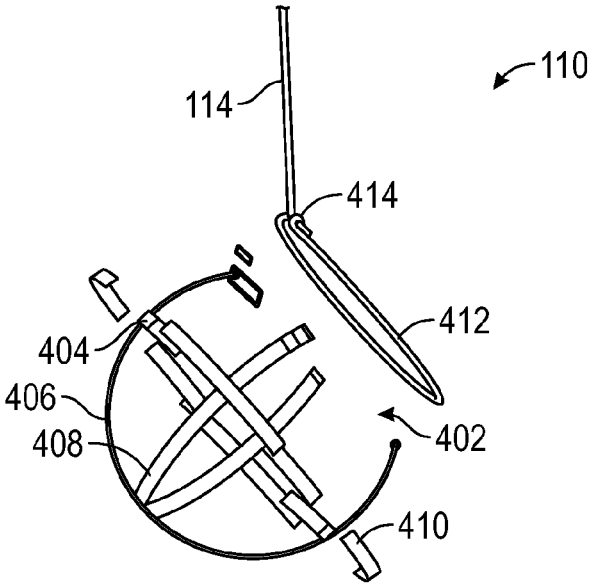
FIG. 4 representatively illustrates a detailed view of a ball retention device in accordance with an exemplary embodiment of the present technology.
Figure 5:
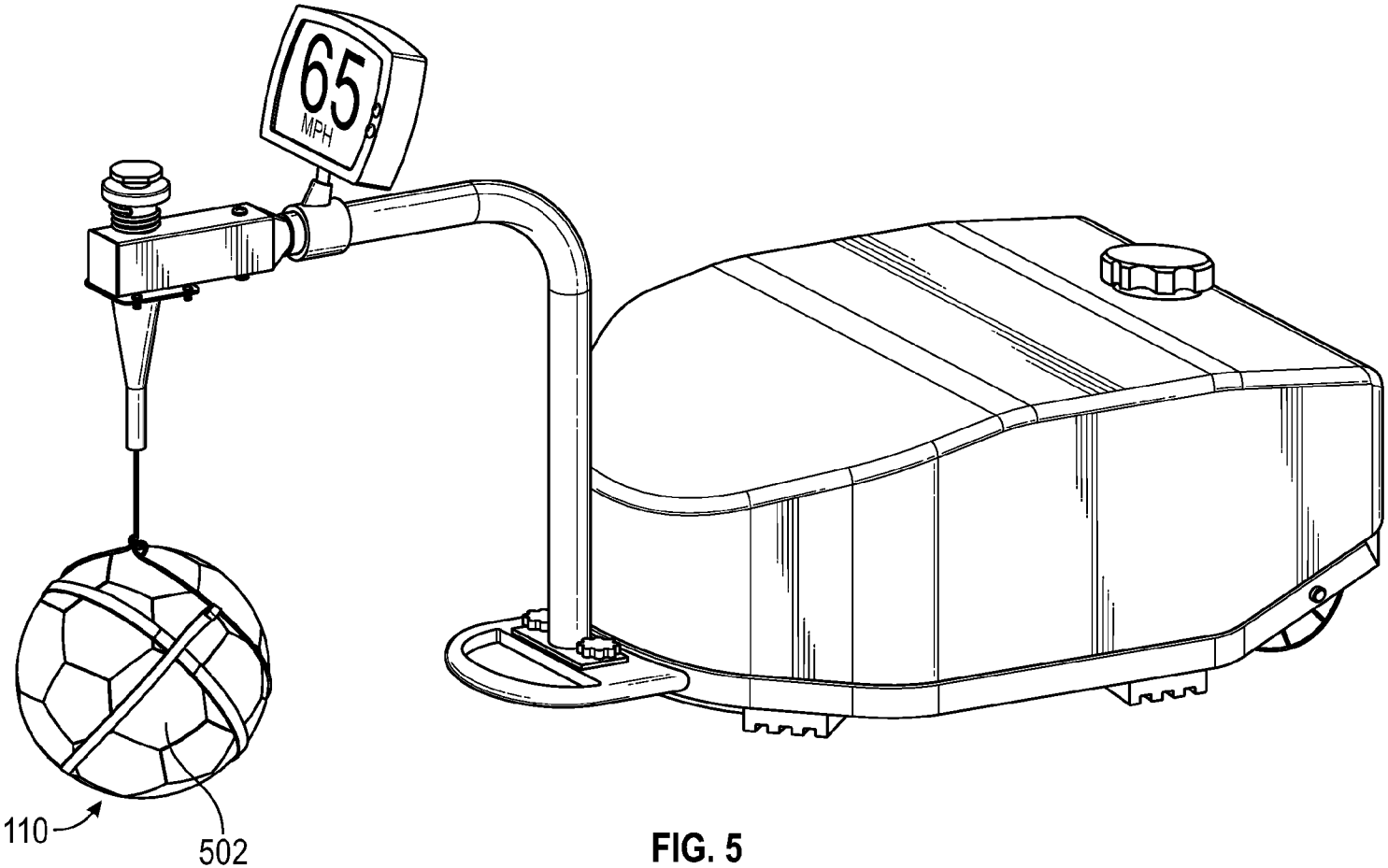
FIG. 5 representatively illustrates a ball positioned within the ball retention device of the training device in accordance with an exemplary embodiment of the present technology.

Referring now to FIGS. 1-3, a training system 100 according to various aspects of the present technology may comprise a base 102 for positioning the training system 100, an energy absorber 104 for dissipating energy imparted to a ball by a user, a force measurement system 106, a display system 108, and a ball retention device 110.

The base 102 positions the training system 100 during use to allow a ball or other athletic equipment (not shown) to be kicked or struck by the user. The base 102 may comprise any suitable system or device for at least temporarily positioning the training system 100 during use. In one embodiment, the base 102 may be configured to allow the training system 100 to be portable and remain at least substantially in place during use. For example, referring now to FIG. 3, the base 102 may comprise a housing 302 having an internal volume that may be selectively filled with a substance such as water or sand to provide additional weight to the base 102. The internal volume may be accessed by an opening 312 disposed along a surface of the housing 302 and a cover 310 may be used to seal or close off the opening 312.

The base 102 may further comprise a frame 304, a set of wheels 306, and a set of feet 308. The frame 304 may be configured to couple to the housing 302, the wheels 306, and the feet 308. The frame 304 may comprise any suitable system or device to support the housing 302 and provide a connection point for the wheels 306 and the feet 308. The frame 304 may be formed integrally with the housing 302 or the frame 304 may be formed as an independent structure configured to be coupled to a lower portion of the housing 302.

The frame 304 may comprise any suitable material such as plastic, metal, or composite material. For example, in one embodiment, the frame 304 may comprise one or more metal elements such as bar stock, square or round tubing, U-channeling, or the like formed or joined together to form a support structure such as an A-frame. The frame 304 may be further configured to conform to the shape and size of the housing 302.

The set of wheels 306 help facilitate movement of the training system 100 and may comprise any suitable system for allowing the housing 302 to be moved. In one embodiment, the set of wheels 306 may comprise one or more traditionally shaped wheel elements positioned along the housing 302. The set of wheels 306 may also comprise a locking element (not shown) configured to prevent the wheels from undesired rotation. For example, two wheels may be positioned along a rear portion of the housing so that a forward end of the housing 302 may be lifted such that the wheels are free to rotate. In an alternative embodiment, the set of wheels 306 may comprise four wheel elements positioned at the rear and front sections of the frame 304 so that the housing 302 may be moved without the need to lift the training system 100 itself. In yet another embodiment, the set of wheels 306 may comprise a single ball shaped element, a set of skids, or any other device that would allow the housing 302 to be rolled or slid along the ground.

The set of feet 308 help keep the training system 100 securely positioned during use. The set of feet 308 may comprise any suitable device for impeding movement of the housing 302. In a first embodiment, the set of feet 308 may comprise a plurality of cleated members disposed along a bottom surface of the frame 304. The cleated members may be configured to fit against the ground when the housing 302 is positioned for use. For example, each cleated member may comprise a rubberized surface have one or more protrusions configured to extend downwardly towards the ground. The size and shape of the protrusions may be selected according to any suitable criteria such as the type of surface the training system 100 will be used on or a height of the frame 304 from the ground. In a second embodiment, the set of feet 308 may comprise a plurality of spikes configured to extend downwardly into the ground.

Referring now to FIG. 2, in an alternative embodiment, the base 102 may be configured to permanent or semi-permanent attachment to a desired location of use. For example, the base 102 may comprise a bracket 202 that is suitably configured to be bolted or otherwise affixed to a ground location. Alternatively, the bracket 202 may comprise an end portion such as a barb or spike that is suitably configured to be inserted into a field surface such as grass, dirt, sand, or the like and secure the training system 100 in place.

Referring now to FIGS. 1-5, the ball retention device 110 is used to securely couple a ball 502 to the training system 100 during use. The ball retention device 110 may be coupled to the base 102 by an arm 112 that is suitably configured to extend upward and away from the base 102 to position the ball 502 far enough away from the base 102 to allow the user sufficient access to the ball 502. For example, in one embodiment, the arm 112 may extend upwardly away from the base 102 at an angle of between about thirty and sixty degrees. In an alternative embodiment, the arm 112 may comprise a generally L-shaped member coupled at a forward end portion 314 of the frame 304 such that the ball 502 may be suspended within the ball retention device 110 and yet at least partially rest on the ground a pre-determined distance away from the base 102 such that the user may kick the ball 502 with a normal kicking motion without contacting the base 102.

The L-Shaped member may extend upward from the frame 304 by any suitable distance and may be determined according to the type of ball 502 that will be used with the training system 100. For example, the L-Shaped member may extend upwardly from the base a distance of between about twelve inches and about twenty-two inches such that a soccer ball or football may be used with the training system 100. In a second embodiment, the height of the arm 112 may extend upwardly from the base a distance of between about six inches and about twelve inches such that a golf ball may be used with the training system 100. Alternatively, the height of the arm 112 may be adjustable to account for varying sizes of balls such as those used for youth sports and regulation adult sized balls. In yet another embodiment, the height of the arm 112 may be set such that the ball retention device 110 is positioned at least a foot above the ground such that a baseball may be properly positioned to allow a user to swing a bat.

The arm 112 may comprise any suitable material such as a metal, plastic, or composite capable of withstanding varying torque forces that result from the ball being kicked or otherwise struck. For example, the arm 112 may comprise an aluminum tube having a flange 316 disposed along a first end to allow the arm 112 to be coupled to the base 102. The arm 112 may be coupled to the base 102 by any suitable method such as by welding or a fastener. In one embodiment, the flange 316 may comprise attachment apertures that extend there through to receive at least one fastener 318 to couple the flange 316 to the forward end portion 314 of the frame 304.

The ball retention device 110 receives and suspends the ball 502 from the arm 112. The ball retention device 110 may comprise any suitable system or device for securely holding the ball 502 before and after being kicked or otherwise struck and set into motion. In one embodiment, and referring now to FIGS. 4 and 5, the ball retention device 110 may comprise a net-like structure configured to receive a ball 502 within an interior portion 402. The net-like structure may be tightened after the ball 502 is positioned within the interior portion 402 to at least partially enclose the ball 502. Alternatively, the net-like structure may be suitably configured to self-tighten around the ball 502.

The net-like structure may comprise one or more straps 404, 406, 408 woven, stitched, or otherwise coupled together to form the interior portion 402. The straps 404, 406, 408 may comprise any suitable material such as a rubber or a webbing made from polypropylene, nylon, polyester, synthetic or natural fibers, Dyneema®, Kevlar®, and the like. For example, in one embodiment, the straps 404, 406, 408 may comprise a polyester strip having a width of between about three-eighths of an inch and about three-quarters of an inch and a length of between about three inches and twenty inches.

One or more of the straps 404, 406, 408 may be individually or collectively coupled together by an elastic strap section 410 to allow the interior portion 402 to be at least partially adjustable in response to different sized balls. For example, a first strap 404 may comprise alternating sections of a non-elastic strap section and an elastic strap section 410 to allow the first strap 404 to stretch lengthwise and better conform to the shape and size of the ball 502. A second and third strap 406, 408 may be similarly constructed such that the entire net-like structure may automatically conform to multiple sizes and/or types of balls.

At least one end portion of each strap 404, 406, 408 may be coupled to a ring 412 configured to provide an opening to the interior portion 402. The ring 412 may be sufficiently sized to allow the ball 502 to pass through. The ring 412 may also be configured to provide a selectively adjustable sized opening so that various types and sizes of balls may be positioned within the interior portion 402. For example, the ring 412 may comprise a generally circular shaped spring device having end portions that may be selectively coupled together. In an alternative embodiment, the ring 412 may comprise a strap or cord that may be adjusted or otherwise cinched to allow the ball 502 to be positioned within or removed from the interior portion 402. In yet a third embodiment, the ring 412 may be formed from a stretchable cord such as a shock cord or elastic cord suitably configured to expand to allow a ball 502 to pass into the interior portion 402 and then shorten to help secure the ball 502 within the interior portion 402.

The ball retention device 110 may be suspended from the arm 112 by a cord 114. The cord 114 may comprise any suitable material such as a fabric rope, paracord, tension wire, rigid member, or the like. The cord 114 may also be configured to have abrasion resistance such that durability of the cord 114 is increased. For example, the cord 114 may be configured to be slack when not under tension or the cord 114 may be at least slightly rigid even when in a non-tension state. The cord 114 may also be suitably configured to have reduced elasticity along the length of the cord 114 to reduce a potential for the cord 114 to be stretched lengthwise after the ball 502 is struck and set into motion.

The cord 114 may be coupled between the arm 112 and the ball retention device 110 by any suitable method. For example, referring now to FIGS. 1 and 7, the cord 114 may be coupled at a first end to a spool 116 positioned proximate the force measurement system 106. The cord 114 may then be fed through the force measurement system 106 and extend downwardly through the energy absorber 104 before being coupled to the ring 412 on a second end.

In an alternative embodiment, the cord 114 may also comprise the ring 412. For example, the cord 114 may sized such that an end portion of the second end may be woven through the straps 404, 406, 408 and then joined back to a mid-portion of the cord 114 by a knot 414 to form the ring 412. The coupling between the mid-portion and the knot 414 may allow the end portion to be selectively adjusted to allow the ball retention device 110 to be cinched around the ball 502.

Figure 6:
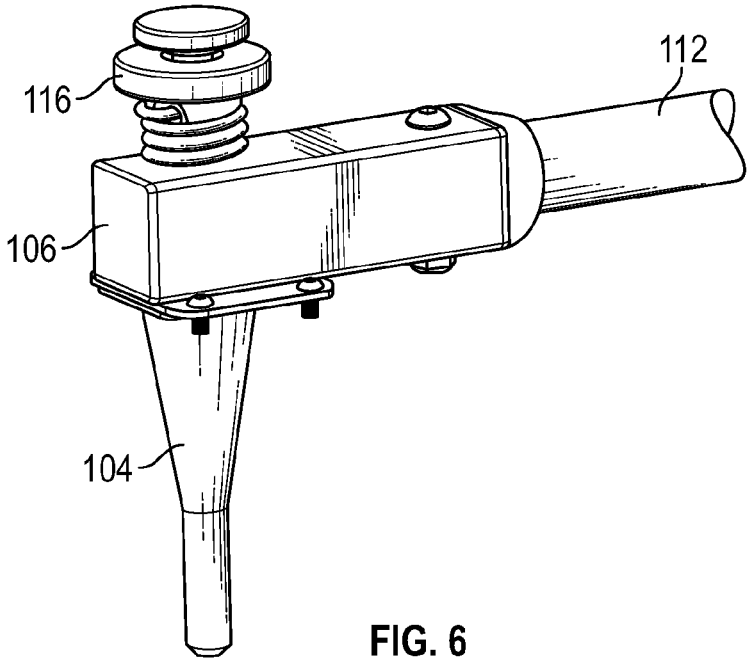
FIG. 6 representatively illustrates a detailed view of a speed sensor and an energy absorber in accordance with an exemplary embodiment of the present technology.
Figure 7:
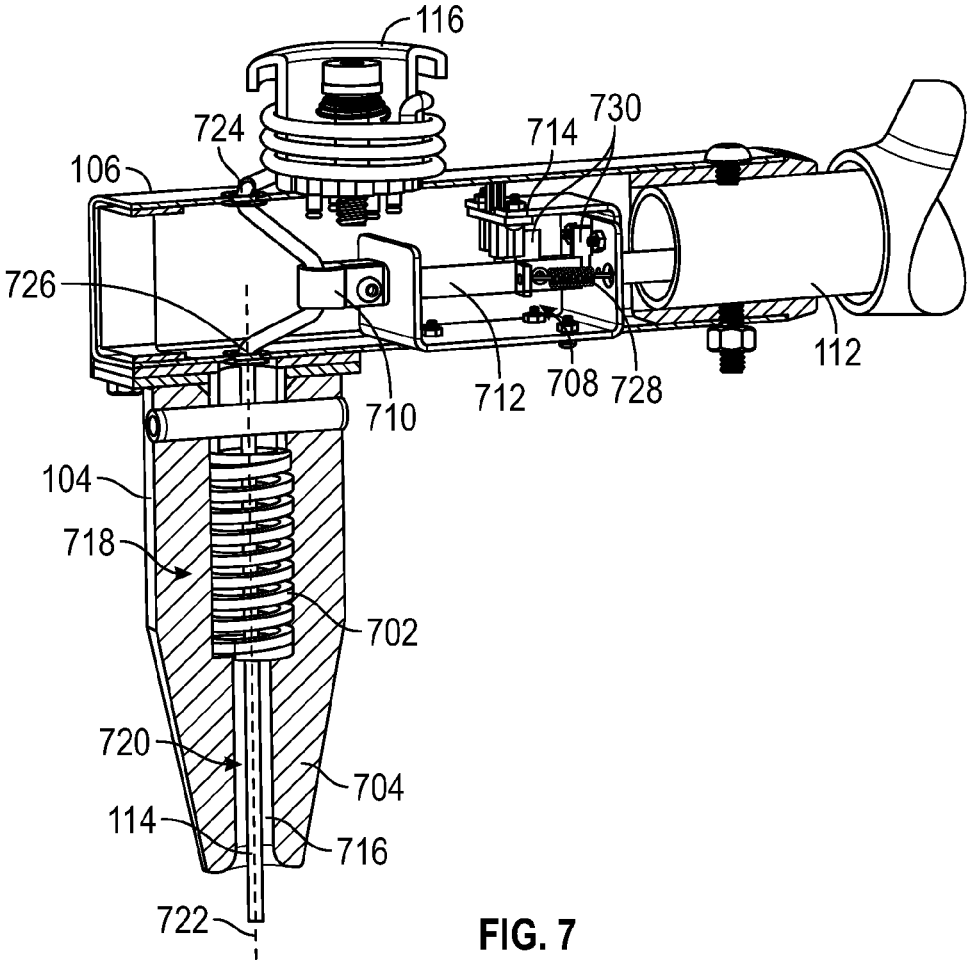
FIG. 7 representatively illustrates a cross-sectional view of the speed sensor and the energy absorber of FIG. 6 in accordance with an exemplary embodiment of the present technology.

The energy absorber 104 absorbs the force imparted to the ball 502 and acts to return the ball 502 to its initial resting position. The energy absorber 104 may comprise any system or device capable of dissipating energy and reducing any oscillation of the ball 502 so that the ball 502 may come to rest more rapidly. Referring now to FIGS. 1, 6, and 7, the energy absorber 104 may be positioned between the ball retention device 110 and force measurement system 106. The energy absorber 104 may be coupled to the force measurement system 106 by any suitable method. For example, the energy absorber 104 may be mechanically attached to an underside of the force measurement system 106.

In one embodiment, the energy absorber 104 may comprise a compression spring 702 positioned within an energy absorbing housing 704. The energy absorbing housing 704 limits movement of the cord 114 to reduce oscillation of the ball as it returns to a state of rest after being struck. The energy absorbing housing 704 may comprise any suitable device for dissipating the energy imparted to the ball 502. For example, in one embodiment, the energy absorbing housing 704 may comprise an elastomeric body suitably configured to resist deflecting under the forces transferred to the cord 114 from the struck ball 502. The elastomeric body may be at least semi-rigid while maintaining some ability to flex under the applied load resulting from the moving ball. The elastomeric body may be suitably configured to act as a dampening system adapted to minimize oscillation.

The energy absorbing housing 704 may further comprise an interior channel 716 extending between first and second end portions of the energy absorbing housing 704. The interior channel 716 may be suitably configured to provide a passageway to allow the cord 114 to extend through the interior of the energy absorbing housing 704. The interior channel 716 may be further configured to receive the compression spring 702. For example, the interior channel 716 may comprise a first zone 718 having a diameter slightly larger than that of the compression spring 702 and a length sufficient to allow the compression spring 702 to be at least partially enclosed within the first zone 718.

The interior channel 716 may comprise a second zone 720 having a diameter less than that of the first zone 718 but larger than the diameter of the cord 114. The diameter of the second zone 720 may be sized such that the cord 114 can pass through without touching an interior wall of the second zone 720 but not so large as to allow the cord 114 to swing through more than about five to fifteen degrees of motion relative to a center line 722 of the interior channel 716. By limiting the ability of the cord 114 to swing or oscillate within the interior channel 716 the angle through which the ball 502 may oscillate is reduced thereby allowing the ball 502 to come to rest more rapidly.

The compression spring 702 may provide the energy absorbing housing 704 with increased resistance to deflection or compression when subjected to a load. The compression spring 702 may also be configured to increase the damping coefficient of the energy absorbing housing 704 to decrease the amount of time required to return the ball retention device 110 to rest after being struck.

The compression spring 702 may comprise any suitable material such as stainless steel alloys, high carbon steel wire, alloy steel or music wire, nickel base alloy wire, brass, and hard drawn wire selected to provide a desired level of stiffness to the energy absorbing housing 704. For example, in one embodiment, the compression spring 702 may comprise a stainless steel alloy having an outer diameter of between about three-quarters of an inch and about one and one-half of an inch and a length of between about one inch and about three inches.

The spool 116 may be positioned along a portion of the arm 112 and/or the force measurement system 106. The spool 116 allows an effective length of the cord 114 to be selectively adjusted to accommodate various sizes of balls. For example, the spool 116 may comprise a rotatable knob coupled to the first end of the cord 114. By rotating the knob in a first direction the effective length of the cord 114 may be shortened thereby raising the ball retention device 110 from the ground to accommodate a larger sized ball 502. Conversely, rotating the knob in a second direction may increase the effective length of the cord 114 and lower the ball retention device 110. In this manner, the ball retention device 110 may be positioned such that any size ball 502 may be properly positioned on or just slightly above ground level.

The force measurement system 106 generates a set of data corresponding to the force applied to the ball 502 when kicked or struck during use. The force measurement system 106 may comprise any suitable system or method for converting a measured force into data pertaining to the ball 502. Referring now to FIGS. 1, 3, and 7, in one embodiment the force measurement system 106 may be disposed proximate a second end of the arm 112 to engage the cord 114 and the energy absorber 104. For example, the force measurement system 106 may be coupled to and extend outwardly away from the second end of the arm 112 such that the force measurement system 106 is disposed above the ball 502 during use. In an alternative embodiment, the force measurement system 106 may be integrated within the arm 112 itself and form a single structural element.

In one representative embodiment, the force measurement system 106 may comprise a speed sensing device 708 suitably adapted to calculate a speed value for the ball 502 that corresponds to how hard the ball 502 was kicked or otherwise struck and set into motion. The speed sensing device 708 may be configured to use a displacement of the cord 114 to calculate the speed value. For example, the speed sensing device may comprise a cord guide 710 connected to a tracking bar 712 that is linked to a sensor 714 configured to measure the force imparted to the ball and generate the speed value.

The cord guide 710 may be coupled to the cord 114 such that any movement of the cord 114 will be transferred through the cord guide 710 and sensed by the sensor 714. Referring now to FIG. 7, the force measurement system 106 may comprise a pair of openings configured to allow the cord 114 to pass through an interior portion of the force measurement system 106. For example, a first opening 724 may be positioned along a top surface of the force measurement system 106 proximate the spool 116 to allow the cord to enter into the interior portion of the force measurement system 106. A second opening 726 may be positioned along a bottom surface of the force measurement system 106 to allow the cord to exit out from the interior portion of the force measurement system 106. The second opening 726 may be at least partially aligned with the first opening 724 such that the cord 114 might pass through the interior portion of the force measurement system 106 in a substantially linear manner.

The cord guide 710 may positioned within the interior portion of the force measurement system 106 at a predetermined distance from the first and second openings 724, 726 and be configured to engage the cord. For example, the cord guide 710 may comprise an element configured to wrap around the cord 114 and route the cord 114 through the interior portion of the force measurement system 106 and prevent the cord from passing linearly through the interior portion of the force measurement system 106 when the ball 502 is positioned in the ball retention device 110 and at rest. A spring 728 may be coupled to the cord guide 710 to maintain the resting position of the cord guide 710 to cause the cord 114 to deflect and be placed under slight tension.

When the ball 502 is struck the resulting forces imparted to the ball 502 may be transferred to the cord 114 causing the cord 114 to be pulled downwardly from the force measurement system 106 as the ball 502 moves. The downward movement of the cord 114 will tend to cause the deflection of the cord 114 within the force measurement system 106 and pull the cord guide 710 and the tracking bar 712 towards the first and second openings 724, 726. As the tracking bar 712 moves it passes by the sensor 714.

The sensor 714 is responsive to the movement of the tracking bar 712 and converts that movement into a signal that is used to calculate the speed value. The sensor 714 may comprise any suitable sensing device such as an accelerometer, a switch, or the like for converting mechanical movement into a signal. The sensor 714 may comprise a purely mechanical system, an electro-mechanical system, or a purely electrical device. In one embodiment the sensor 714 may comprise a Hall Effect sensor suitably configured to convert the movement of the tracking bar 712 into an electronic signal that is used to generate the speed value. For example, the tracking bar 712 may comprise a pair of tabs 730 separated by a set distance that are suitably configured to be sensed by the sensor 714 as they each pass by the sensor 714. The sensor 714 may be configured to record a time between the sensing of the first tab and the second tab and use this value along with the known distance between the tabs to calculate a velocity that corresponds to the velocity that the ball 502 was traveling at after being kicked or struck. In this embodiment, the greater the force applied to the ball 502 the greater the speed at which the tracking bar 712 may pass by the sensor 714 and may indicate a higher speed value for the ball 502.

Referring again to FIGS. 1 and 2, the display system 108 may be communicatively linked to the force measurement system 106 and be suitably configured to provide a visual indication of the calculated speed value and/or any other generated data relating to the ball 502. For example, the display system 108 may comprise a processing unit adapted to receive the signal from the sensor 714 and calculate the associated speed value. The calculated speed value may then be displayed to the user and/or saved in a memory device.

The display system 108 may also be configured to communicate to a wireless communications device such as a smartphone, portable computing device, or the like. The display system 108 may be configured to communicate with the wireless communications device according to any suitable criteria or suitable wireless communication protocol, such as ZigBee (e.g. IEEE 802.15.4), Wi-Fi (e.g. IEEE 802.11), Bluetooth, and the like. For example, the wireless communications device may be configured to receive and track the generated data and/or speed values for the ball.

These and other embodiments for methods of detecting and calculating the speed of a ball may incorporate concepts, embodiments, and configurations as described with respect to embodiments of apparatus for detecting and calculating the speed of a ball as described above. The particular implementations shown and described are illustrative of the technology and its best mode and are not intended to otherwise limit the scope of the present technology in any way. Indeed, for the sake of brevity, conventional manufacturing, connection, preparation, and other functional aspects of the system may not be described in detail. Furthermore, the connecting lines shown in the various figures are intended to represent exemplary functional relationships and/or physical couplings between the various elements. Many alternative or additional functional relationships or physical connections may be present in a practical system.

The technology has been described with reference to specific exemplary embodiments. Various modifications and changes, however, may be made without departing from the scope of the present technology. The description and figures are to be regarded in an illustrative manner, rather than a restrictive one and all such modifications are intended to be included within the scope of the present technology. Accordingly, the scope of the technology should be determined by the generic embodiments described and their legal equivalents rather than by merely the specific examples described above. For example, the steps recited in any method or process embodiment may be executed in any order, unless otherwise expressly specified, and are not limited to the explicit order presented in the specific examples. Additionally, the components and/or elements recited in any apparatus embodiment may be assembled or otherwise operationally configured in a variety of permutations to produce substantially the same result as the present technology and are accordingly not limited to the specific configuration recited in the specific examples.

Benefits, other advantages and solutions to problems have been described above with regard to particular embodiments; however, any benefit, advantage, solution to problems or any element that may cause any particular benefit, advantage or solution to occur or to become more pronounced are not to be construed as critical, required or essential features or components.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present technology, in addition to those not specifically recited, may be varied or otherwise particularly adapted to specific environments, manufacturing specifications, design parameters or other operating requirements without departing from the general principles of the same.

The present technology has been described above with reference to a preferred embodiment. However, changes and modifications may be made to the preferred embodiment without departing from the scope of the present technology. These and other changes or modifications are intended to be included within the scope of the present technology, as expressed in the following claims.

The invention claimed is:

1. A training device for allowing a user to kick a ball from a ground location, comprising:

a base portion having an attachment arm extending upwardly and away from the base portion from a first end of the attachment arm;

a cord coupled at a first end to a second end of the attachment arm;

a net coupled to a second end of the cord, wherein the net is configured to position the ball at a resting position;

an energy absorber extending downwardly from the second end of the attachment arm and engaging the cord, wherein the energy absorber is configured to:

dampen an oscillation of the cord in response to a kicking force applied to the ball; and return to the ball to the resting position; and a force measurement system linked to the energy absorber and coupled to the cord, wherein the force measurement system is configured to measure the kicking force and calculate a set of data corresponding to the force applied to the ball when kicked by the user.

2. A training device according to claim 1, wherein the base portion comprises a housing.

3. A training device according to claim 2, wherein the housing comprises:

an internal volume;

an opening configured to provide selective access to the internal volume;

a frame disposed along a lower portion of the housing;

a set of wheels coupled to the frame; and a set of feet coupled to a bottom surface of the frame.

4. A training device according to claim 1, wherein the attachment arm comprises a generally L-shaped member.

5. A training device according to claim 1, wherein the net comprises a net-like structure configured to receive the ball within an interior portion.

6. A training device according to claim 5, wherein the net-like structure comprises a plurality of straps coupled together to form the interior portion.

7. A training device according to claim 6, wherein the net-like structure further comprises at least one elastic strap section disposed along a portion of at least one of the plurality of straps.

8. A training device according to claim 6, wherein the net-like structure further comprises a ring coupled to at least one end portion of at least one of the plurality of straps, wherein the ring comprises an end section of the cord joined back to a mid-section of the cord by a knot configured to allow the end section to be selectively adjusted to allow the net to be cinched around the ball.

9. A training device according to claim 6, wherein the net-like structure further comprises a ring formed by a stretchable cord configured to expand to allow an opening to the interior portion to be selectively adjusted to allow the ball to be positioned within the interior portion.

10. A training device according to claim 1, wherein the energy absorber comprises:

an energy absorbing housing comprising an interior channel configured to allow the cord to pass through the energy absorbing housing; and a compression spring positioned within the interior channel of the energy absorbing housing.

11. A training device according to claim 10, wherein the energy absorbing housing comprises a dampening system adapted to minimize oscillation.

12. A training device according to claim 10, wherein the energy absorbing housing comprises an elastomeric body suitably configured to resist deflecting under the forces transferred to the cord from the struck ball.

13. A training device according to claim 10, wherein the interior channel of the energy absorbing housing comprises:

a first zone configured to receive the compression spring; and a second zone having a diameter less than that of the first zone but larger than a diameter of the cord.

14. A training device according to claim 1, further comprising a spool disposed proximate the second end of the attachment arm, wherein the spool is configured to selectively adjust an effective length of the cord.

15. A training device according to claim 1, wherein the force measurement system comprises a speed sensing device adapted to generate the set of data corresponding to the force applied to the ball.

16. A training device according to claim 15, wherein the speed sensing device comprises:

a cord guide positioned within an interior portion of the force measurement system and configured to engage the cord;

an encoder connected to the cord guide; and a sensor responsive to a movement of the encoder and configured to measure the force imparted to the ball and generate the set of data.

17. A training device according to claim 16, wherein the sensor comprises a Hall Effect sensor suitably configured to convert the movement of the encoder into an electronic signal that is used to generate the set of data.

18. A training device according to claim 1, further comprising a display system communicatively linked to the force measurement system and configured to provide a visual indication of the generated set of data.

19. A training device for allowing a user to kick a ball from a ground location, comprising:

a portable base comprising:

a set of wheels disposed along a first end portion of the portable base; and a set of feet disposed along a bottom surface of the portable base;

a ball retention device coupled to an opposing second end portion of the portable base, wherein the ball retention device comprises:

an attachment arm having a first and second end, wherein the attachment arm extends upwardly and away from the second end portion of the portable base from the first end of the attachment arm;

a cord coupled at a first end to the second end of the attachment arm, wherein the cord is configured to extend downwardly from the second end of the attachment arm towards the ground; and a net coupled to a second end of the cord, wherein the net:

comprises an interior portion configured to receive the ball; and is configured to position the ball at a resting position corresponding to the ground location;

an energy absorber extending downwardly from the second end of the attachment arm and engaging the cord, wherein the energy absorber is configured to:

dampen an oscillation of the cord in response to a kicking force applied to the ball; and return to the ball to the resting position; and a force measurement system linked to the energy absorber and coupled to the cord, wherein the force measurement system is configured to measure the kicking force and calculate a speed value for the ball corresponding to the kicking force applied to the ball by the user.

20. A training device according to claim 19, wherein the portable base comprises:

an internal volume;

an opening configured to provide selective access to the internal volume; and a frame disposed along a lower portion of the housing, wherein the frame is configured to couple the set of wheels and the set of feet to the portable base.

21. A training device according to claim 19, wherein the set of feet comprise a plurality of cleated members.

22. A training device according to claim 19, wherein the net comprises:

a plurality of straps coupled together to form the interior portion;

a ring coupled to at least one end portion of at least one of the plurality of straps, wherein the ring comprises an end section of the cord joined back to a mid-section of the cord by a knot configured to allow the end section to be selectively adjusted to allow the net to be cinched around the ball; and at least one elastic strap section coupled to at least one of the plurality of straps.

23. A training device according to claim 19, wherein the energy absorber comprises:

an energy absorbing housing comprising:

an interior channel configured to allow the cord to pass through energy absorbing housing; and a dampening system adapted to minimize oscillation; and a compression spring positioned within an interior channel of the energy absorbing housing.

24. A training device according to claim 23, wherein the energy absorbing housing comprises an elastomeric body suitably configured to provide critical dampening in response to the kicking force transferred to the cord from the kicked ball.

25. A training device according to claim 23, wherein the interior channel of the energy absorbing housing comprises:

a first zone configured to receive the compression spring; and a second zone having a diameter less than that of the first zone but larger than a diameter of the cord.

26. A training device according to claim 19, wherein the ball retention device further comprises a spool disposed proximate the second end of the attachment arm, wherein the spool is configured to selectively adjust an effective length of the cord.

27. A training device according to claim 19, wherein the force measurement system comprises:

a cord guide positioned within the interior portion of the force measurement system and configured to engage the cord;

an encoder connected to the cord guide; and a Hall Effect sensor responsive to a movement of the encoder and configured to:

convert the movement of the encoder into an electronic signal;

measure the kicking force imparted to the ball according to the electronic signal; and generate the speed value based on the measured kicking force.

28. A training device according to claim 19, further comprising a display system communicatively linked to the force measurement system and configured to provide a visual indication of the generated speed value.

* * * * *